US006634907B2

(12) United States Patent
Takatsuki et al.

(10) Patent No.: US 6,634,907 B2
(45) Date of Patent: Oct. 21, 2003

(54) CONNECTOR

(75) Inventors: Kozue Takatsuki, Yokkaichi (JP); Hajime Kawase, Yokkaichi (JP); Ryotaro Ishikawa, Yokkaichi (JP); Yuuichi Nankou, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 68 days.

(21) Appl. No.: 09/985,166

(22) Filed: Nov. 1, 2001

(65) Prior Publication Data

US 2002/0052154 A1 May 2, 2002

(30) Foreign Application Priority Data

Nov. 1, 2000 (JP) ..... 2000-334947

(51) Int. Cl.[7] ..... H01R 13/40
(52) U.S. Cl. ..... 439/595; 439/752
(58) Field of Search ..... 439/595, 752, 439/701, 695

(56) References Cited

U.S. PATENT DOCUMENTS 5,713,760 A 2/1998 Chemin
5,944,558 A * 8/1999 Iwahori ..... 439/595
5,989,066 A 11/1999 Cox
6,000,966 A * 12/1999 Dechanteloup et al. ..... 439/595
6,048,226 A * 4/2000 Iwahori ..... 439/595
6,165,011 A * 12/2000 Fukuda ..... 439/595
6,179,660 B1 * 1/2001 Salaguinto et al. ..... 439/595
6,332,803 B1 * 12/2001 Matsuda et al. ..... 439/488
6,416,365 B1 * 7/2002 Iwahori ..... 439/752
6,478,620 B1 * 11/2002 Bonavita et al. ..... 439/595

FOREIGN PATENT DOCUMENTS

| | | |
|---|---|---|
| EP | 716475 | 6/1996 |
| EP | 827236 | 3/1998 |
| JP | 9-219235 | 8/1997 |

* cited by examiner

*Primary Examiner*—Tho D. Ta
*Assistant Examiner*—James R. Harvey
(74) *Attorney, Agent, or Firm*—Banner & Witcoff, Ltd.

(57) ABSTRACT

The invention allows, in a connector having a moving plate provided at the anterior of a connector housing, a retainer to be attached to this connector housing from the anterior. A retainer attachment hole 17, for allowing a retainer 40 to be attached, is formed at an anterior end face of a connector housing 10. A window hole 36 is formed in a moving plate 30, at least a portion of the retainer 40 protruding towards the anterior from this window hole 36. Consequently, the retainer 40 can be pushed in, and other operations can be performed thereto, from the anterior of the moving plate 30. That is, the retainer 40 can be attached from the anterior to the connector housing 10.

14 Claims, 12 Drawing Sheets

CONNECTOR

TECHNICAL FIELD

The present invention relates to an electrical connector provided with a moving plate and a retainer.

BACKGROUND TO THE INVENTION

One example of a conventional connector provided with a moving plate and a retainer is described in JP-9-219235. In this connector, a hood protrudes towards the anterior from a connector housing. Tabs of male terminal fittings that have been inserted into the connector housing protrude into the hood. These tabs are fitted into position fixing holes formed within a moving plate that is provided, in a manner whereby it can be moved, within the hood. The retainer is inserted into the connector housing and retains the terminal fittings.

In this connector, the retainer is a side retainer, i.e., it is attached to the connector housing from a side face thereof. This type of retainer has the following problem. When a connector is provided with a retainer, the retainer is generally placed in a temporary retaining position which allows the terminal fittings to be inserted into or removed from the connector housing. The connector is transported to the site where the terminal fittings will be attached while the retainer is in this temporary retaining position. At the site, the terminal fittings are inserted into the connector housing, then the retainer is pushed in to a main retaining position, this preventing the terminal fittings from being removed.

The retainer which is in the temporary retaining position protrudes from an outer side face of the connector housing. Consequently, there is a risk that other components may strike against the retainer while the connector is being transported to the attaching site, this pushing the retainer into the main retaining position. If this occurs, the retainer must be pulled out again to the temporary retaining position when it is at the attachment site, thus resulting in extra work.

In order to deal with this problem, the retainer may be fitted from the anterior into the hood of the connector housing, facing towards an innermost face thereof. If the retainer is attached from the anterior, the retainer will be surrounded by the hood even if it protrudes from an anterior end face of the connector housing while it is in the temporary retaining position. Consequently, other components will not strike against the retainer while it is in this protruding state, and the retainer will not be pushed into the main retaining position.

However, conventional connectors have the moving plate located at the anterior of the connector housing. This presence of this moving plate prevents the retainer from being attached from the anterior of the connector housing.

The present invention has taken the above problem into consideration and, in a connector having a moving plate provided within a hood of a connector housing, it aims to allow a retainer to be attached to the connector housing from the anterior.

SUMMARY OF THE INVENTION

According to the invention there is provided an electrical connector comprising a housing having a hood protruding at the anterior side in the connection direction thereof, terminal fittings insertable into said housing from the posterior side to protrude into said hood, a movable plate within said hood and adapted for movement in an anterior/posterior direction, said plate having holes through which said fittings protrude in use, and a retainer movable in said housing to retain terminal fittings therein, characterized in that said housing includes a retainer attachment opening in the anterior side thereof at the innermost face of said hood, and a window is provided in said movable plate to permit insertion of said retainer therethrough.

This arrangement permits a retainer to be placed in a protected waiting position in which inadvertent movement to the retained position is unlikely.

In a preferred embodiment the window permits through movement of the retainer from the anterior to the posterior, thus facilitating independent movement of retainer and movable plate.

Preferably the hood is circumferentially continuous and is adapted for guiding a movable plate having flat plate-like base and a continuous upstanding wall. A sealing member is preferably provided on the outer and inner surfaces of said wall so as to provide waterproofing from the inner side of said hood to the outer surface of the corresponding connector which is inserted therein.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
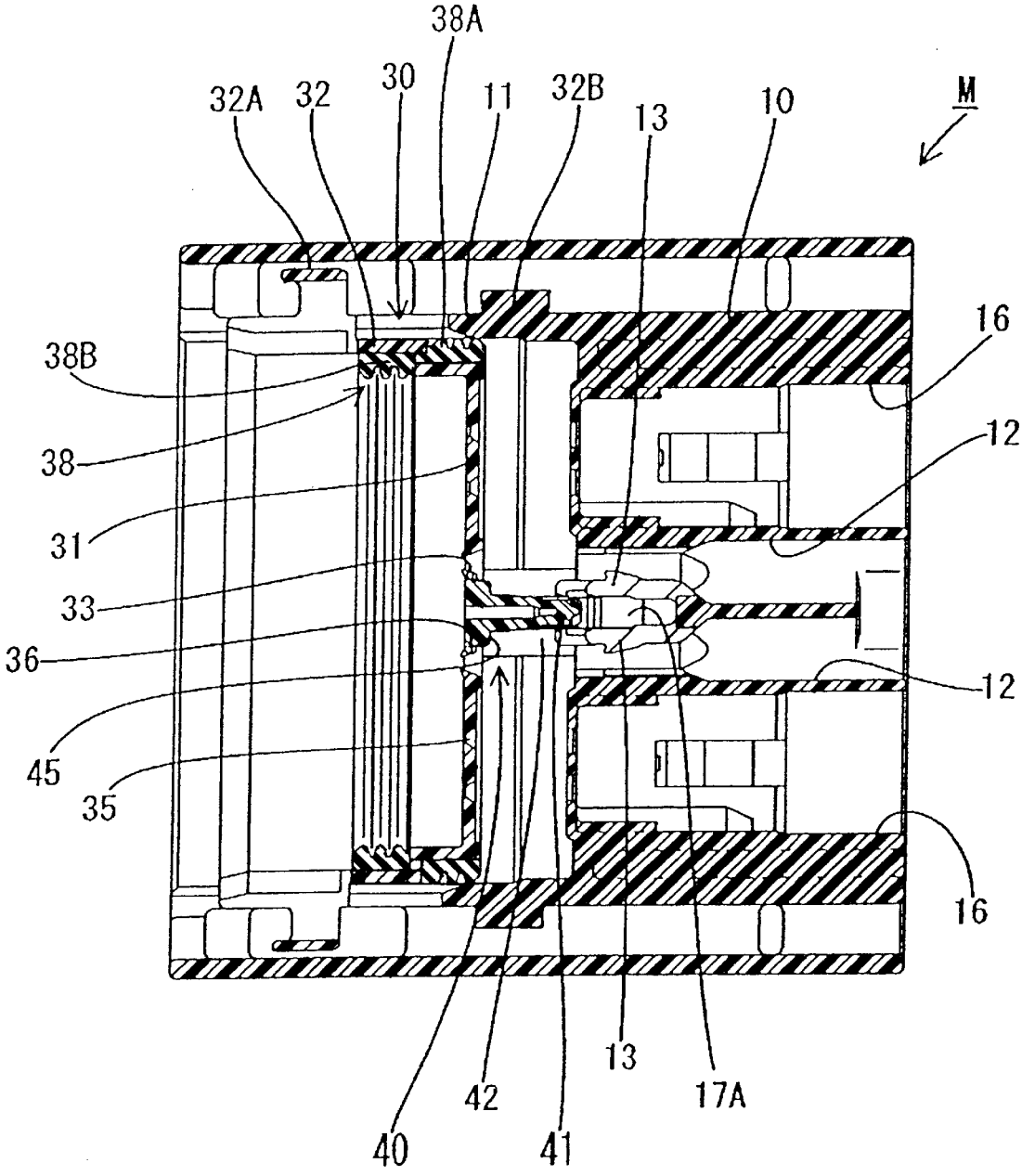
FIG. 1 is a horizontal cross-sectional view showing a retainer in a temporary retaining state.
Figure 2:
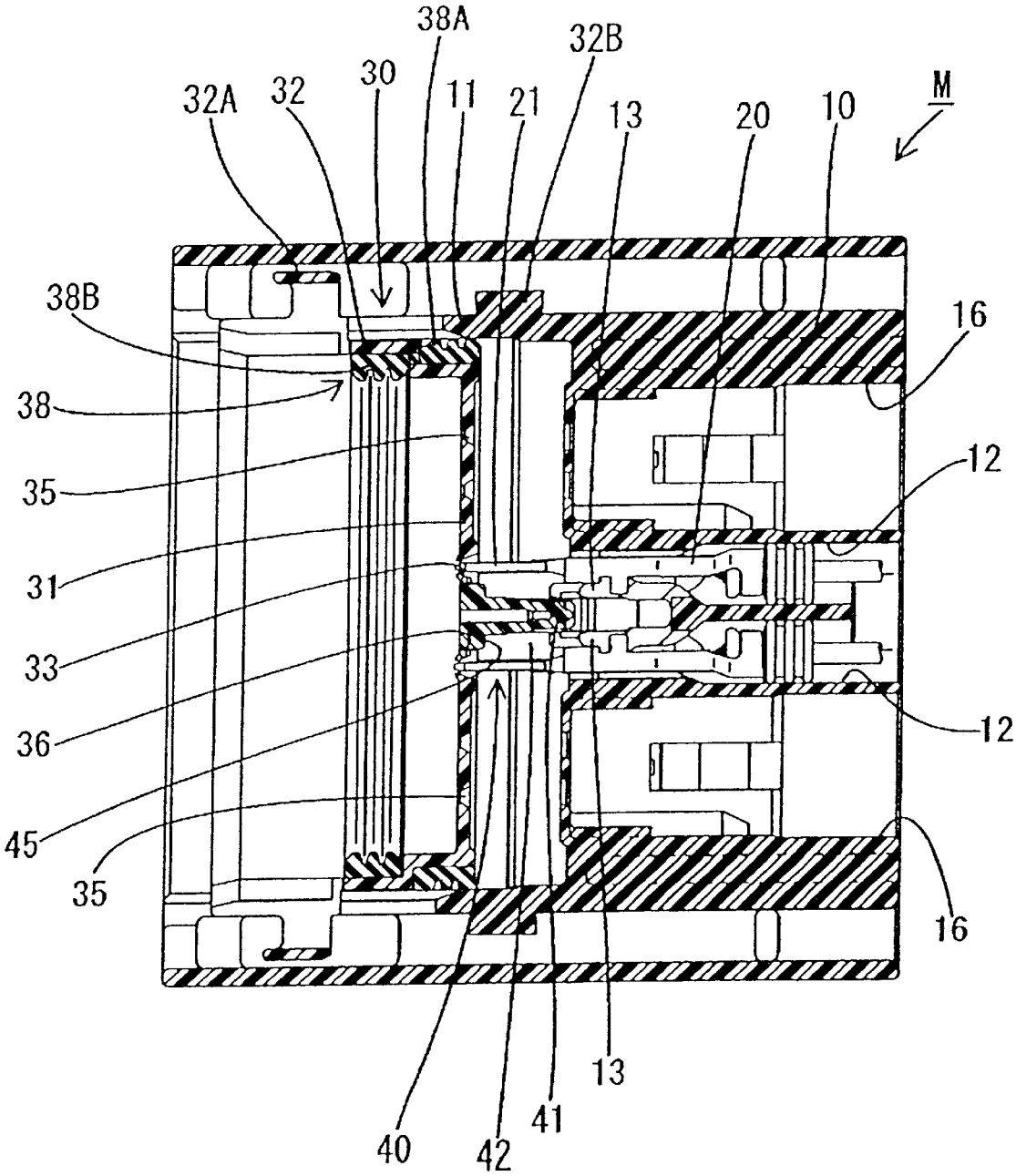
FIG. 2 is a horizontal cross-sectional view showing terminal fittings in an inserted state whereby they are temporarily retained by the retainer.
Figure 3:
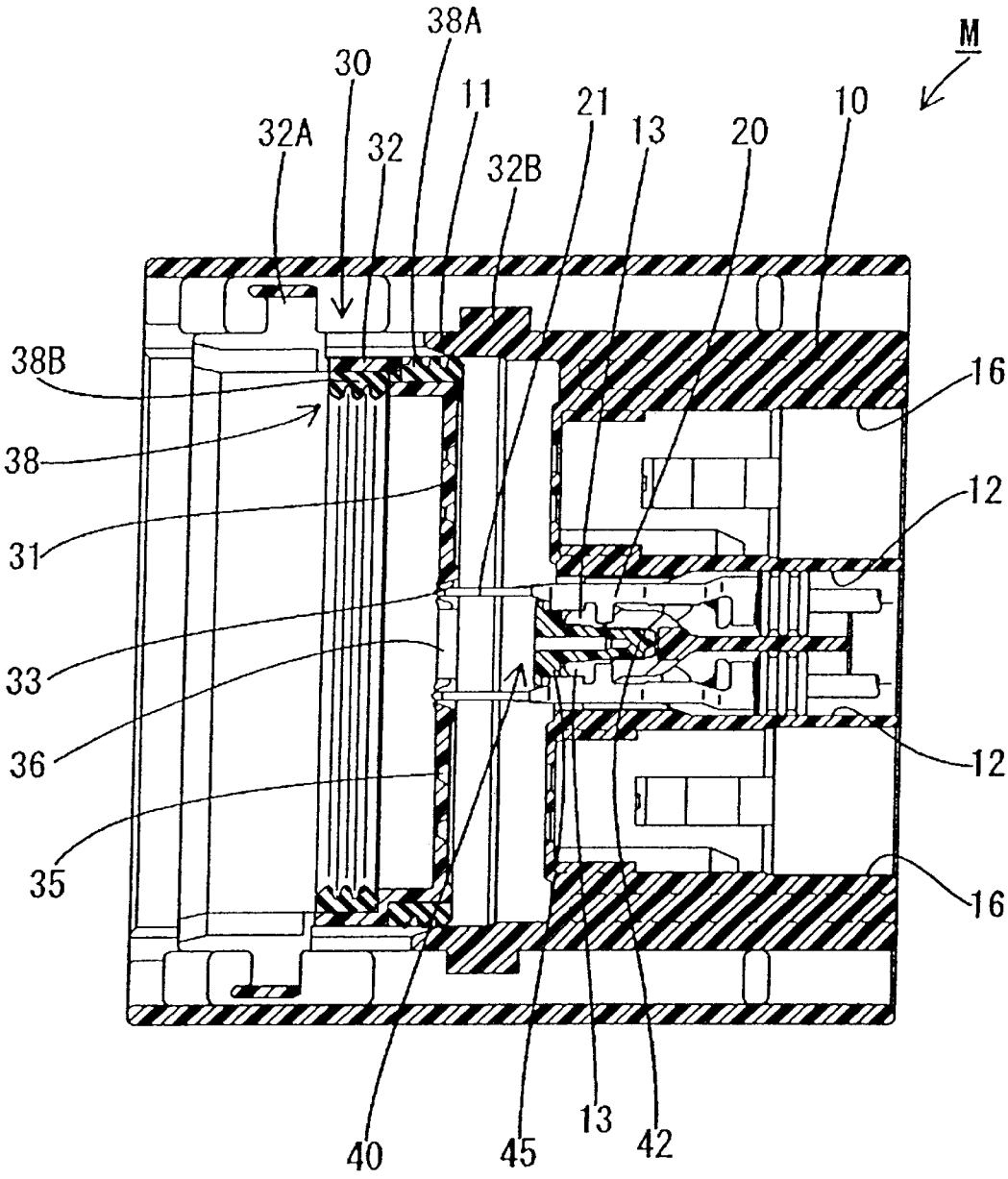
FIG. 3 is a horizontal cross-sectional view showing the retainer in a main retaining state.

An embodiment of the present invention is described below with the aid of FIGS. 1 to 15.

A connector M is provided with a connector housing 10, male terminal fittings 20, a moving plate 30, and a retainer 40. In the following description, the anterior direction is on the left side with reference to FIG. 1, and the up-down direction is also taken with reference to FIG. 1.

The connector housing 10 is formed from plastic. A hood 11 protrudes to the anterior from an outer circumference of an anterior end face of this connector housing 10. A plurality of cavities 12 are formed within the connector housing 10, these cavities 12 being located therein in an approximately central location relative to the up-down direction thereof, and being horizontally aligned in an upper and a lower row. The male terminal fittings 20, which are inserted into these cavities 12, are doubly retained therein by plastic lances 13 and the retainer 40. Large diameter cavities 14 are formed to the left and right of the two rows of cavities 12. Terminal fittings (not shown) inserted into these large diameter cavities 14 are retained only by plastic lances 15. Housing grooves 16, into which sub connectors (not shown) are fitted from the posterior, are formed above and below the cavities 12.

The upper and lower rows of cavities 12 are symmetrical. The plastic lances 13 are formed in the anterior end portions thereof and extend towards the anterior in a cantilevered shape. The plastic lances 13 of the upper rows extend along lower faces of the cavities 12, and the plastic lances 13 of the lower rows extend along upper faces of the cavities 12. Bending spaces 17A, which allow the plastic lances 13 to bend resiliently, are formed between the upper and lower rows of plastic lances 13 and open onto an anterior end face of the connector housing 10. The plastic lances 13 bend resiliently into the bending spaces 17A as a result of making contact with the male terminal fittings 20 while these are being inserted from the posterior into the cavities 12. This contact is released after the male terminal fittings 20 have been inserted to a correct position, the plastic lances 13 return resiliently to their original position and engage with the male terminal fittings 20, thereby retaining them. After the male terminal fittings 20 have been inserted, tabs 21 at anterior ends thereof protrude from the anterior end face (the innermost face of the hood 11) of the connector housing 10 into the hood 11.

The bending spaces 17A join with one another between the adjacent cavities 12, thereby forming, in their entirety, a long and narrow slit that extends in a left-right direction. When the bending spaces 17A are in a free state, whereby the plastic lances 13 have not bent resiliently therein, a removal preventing member 41 of the retainer 40 can be fitted into the bending spaces 17A from the anterior in a manner whereby this removal preventing member 41 does not rattle up or down. Furthermore, a left and right pair of guiding holes 17B is formed at the left and right sides, respectively, of the bending spaces 17A. These guiding holes 17B join with the bending spaces 17A and open into the anterior end face of the connector housing 10. Guiding members 42 of the retainer 40 can be fitted into these guiding holes 17B in a manner whereby they do not rattle in the up-down or left-right directions. In this manner, the bending spaces 17A and the guiding holes 17B form a retainer attachment hole 17 that opens into the innermost face of the hood 11 of the connector housing 10. Moreover, temporary retaining receiving members 18A and main retaining receiving members 18B protrude from inner side faces of the guiding holes 17B. Stopping members 43 of the retainer 40 engage with these receiving members 18A and 18B, thereby maintaining the retainer 40 in a temporary retaining position and a main retaining position, respectively, relative to the connector housing 10.

Next, the moving plate 30 will be described. The moving plate 30 is made from plastic, and fixes the position of the tabs 21 of the male terminal fittings 20 (these tabs 21 protrude from the anterior end face (the innermost face of the hood 11) of the connector housing 10 into the hood 11). The moving plate 30 is formed in a unified manner from a sheet-like plate main body 31, which is parallel to and has the same shape as the anterior end face of the connector housing 10, and a guiding cylindrical member 32 that protrudes towards the anterior from the outer circumference of the plate main body 31 and makes contact with the inner circumference of the hood 11. The plate main body 31 is provided with position fixing holes 33, 34 and 35. The tabs 21 of the male terminal fittings 20 that have been inserted into the upper and lower rows of cavities 12 pass through the position fixing holes 33. Tabs protruding from male terminal fittings (not shown) of the sub connectors fitted into the housing grooves 16 pass through the position fixing holes 34. Tabs of the male terminal fittings (not shown) inserted into the large diameter cavities 14 pass through the position fixing holes 35.

A window hole 36, which connects with the bending spaces 17A and the guiding holes 17B of the connector housing 10, and which is formed on the face opposite the retainer 40 (the retainer attachment hole 17), passes through the plate main body 31 from the anterior face to the posterior face thereof. The shape and dimensions of the window hole 36 are such that the retainer 40 can be passed therethrough. The window hole 36 is located between the rows of position fixing holes 33 (the tabs 21 of the male terminal fittings 20 inserted into the upper and lower rows of cavities 12 are passed through these position fixing holes 33). Recessed members 37 are formed at upper and lower edges of the window hole 36, each recessed member 37 joining individually with one of the position fixing holes 33. Supporting members 45 of the retainer 40 pass through these recessed members 37.

A sealing member 38 is formed in a unified manner on the guiding cylindrical member 32 of the moving plate 30. This sealing member 38 is formed from an outer circumference sealing member 38A, which extends along an outer circumference of a posterior end portion of the guiding cylindrical member 32 (i.e., the portion thereof close to the plate main body 31), and an inner circumference sealing member 38B, this being located further towards the anterior than the outer circumference sealing member 38A and extending along an inner circumference of the guiding cylindrical member 32. These sealing members 38A and 38B are connected via a plurality of joining holes 39 formed at intervals along the circumference thereof.

A cam pin receiving member 32A is formed in each of the upper and lower sides of the guiding cylindrical member 32. While the connector M is being fitted with a corresponding connector F, cam pins (not shown) of this corresponding connector F fit into the cam pin receiving members 32A to form a unified state, then are fitted into cam grooves of a lever (not shown). The lever is rotated using rotative axes 32B of the guiding cylindrical member 32 as its center, the cam operation causing the corresponding connector F to become unified with the moving plate 30 and to be drawn towards the connector housing 10 until a fitted state is reached.

The retainer 40 is made from plastic, and is molded in a unified manner so that it has the removal preventing member 41 that extends as a long horizontal plate in a left-right direction, and the pair of guiding members 42 that are formed on the left and right ends of the removal preventing member 41, these guiding members 42 having long plate-shaped faces which extend in an anterior-posterior direction and are formed at approximate right angles to the removal preventing member 41. Both the removal preventing member 41 and the guiding members 42 form an approximately unified face at the anterior end face of the retainer 40.

However, posterior end portions of the guiding members 42 protrude further towards the posterior (the direction in which the retainer 40 is attached to the connector housing 10) than the removal preventing member 41.

The stopping members 43 are formed as an anterior and posterior protruding pair in each of outer side faces of the posterior end portions of the guiding members 42 (i.e., those portions protruding to the posterior relative to the removal preventing member 41). The stopping members 43 fit with the temporary retaining receiving members 18A of the guiding holes 17B in a manner whereby they grip the temporary retaining receiving members 18A from the anterior and posterior sides thereof, thereby maintaining the retainer 40 in the temporary retaining position relative to the connector housing 10. When the retainer 40 is in the temporary retaining position, the removal preventing member 41 is not in an inserted state within the bending spaces 17A. Consequently, the plastic lances 13 are able to bend resiliently into these bending spaces 17A, allowing the male terminal fittings 20 to be inserted into or removed from the cavities 12.

When the retainer 40 is pushed inwards from the temporary retaining position to the main retaining position, the stopping members 43 fit with the main retaining receiving members 18B of the guiding holes 17B in a manner whereby they grip the anterior and posterior sides thereof, this maintaining the retainer 40 in the main retaining position relative to the connector housing 10. When the retainer 40 is in the main retaining position, the removal preventing member 41 is fitted into the bending spaces 17A in such a manner that it does not rattle. Consequently, the plastic lances 13 are prevented from bending resiliently towards the bending spaces 17A (i.e., in the direction for removing the male terminal fittings 20), thereby preventing the male terminal fittings 20 from being removed.

Further, the posterior end portions of the guiding members 42 (i.e., the tips thereof relative to the direction in which the retainer 40 is attached to the retainer attachment hole 17) grow gradually smaller in the up-down direction, forming tapered guiding tips 44. The anterior end portion of the removal preventing member 41 has the supporting members 45 formed thereon at locations corresponding to the cavities 12 (i.e., corresponding to each plastic lance 13), these supporting members 45 protruding upwards and downwards, respectively. When the retainer 40 is in the main retaining position, these supporting members 45 make contact, via the bending spaces 17A, with the anterior end portions of the male terminal fittings 20. Consequently, the anterior end portions of the male terminal fittings 20 are prevented from inclining towards the bending spaces 17A, thereby maintaining the male terminal fittings 20 in a stable position. Moreover, when the retainer 40 is in the main retaining position, the supporting members 45 make contact with anterior ends of the plastic lances 13, thereby functioning as stoppers which prevent the retainer 40 from being pushed in too far.

The present embodiment is configured as described above. Next, the operation thereof will be described.

When the connector M of the present embodiment is to be assembled, the moving plate 30 is first housed within the hood 11 (see FIG. 1). The moving plate 30 is maintained in a fitting waiting position located to the anterior of the anterior end face (the innermost face of the hood 11) of the connector housing 10, a space remaining between the two. Next, the retainer 40 is attached, in a temporary retaining state, to the connector housing 10 by being passed through the window hole 36 of the moving plate 30. At this juncture, posterior end portions of the guiding members 42 of the retainer 40 are fitted into the guiding holes 17B of the retainer attachment hole 17, and the stopping members 43 of the retainer 40 engage with the temporary retaining receiving members 18A. By this means, the retainer 40 is maintained in the temporary retaining position (see FIG. 1). The retainer 40 is located such that the anterior end face thereof forms an approximately unified face with the anterior end face of the plate main body 31 of the moving plate 30.

From this state, the male terminal fittings 20 are inserted into the cavities 12 and are retained by the plastic lances 13. Moreover, the tips of the tabs 21 protruding from the anterior end face of the connector housing 10 are fitted into the position fixing holes 33 of the moving plate 30 (see FIG. 2). By this means, the tabs 21 are maintained in a state whereby they do not move in the up-down or left-right directions, and are ready to be fitted with female terminal fittings (not shown) of the corresponding connector F.

After all the male terminal fittings 20 have been fitted, the retainer 40 is pushed in from the temporary retaining position to the main retaining position. This may be done by pushing, with a finger, the anterior end face of the retainer 40 that is visible to the eye and protrudes from the window hole 36 of the moving plate 30 so as to form an approximately unified face therewith. After the retainer 40 has been pushed to the main retaining position, the removal preventing member 41 fits within the bending spaces 17A, thereby preventing the plastic lances 13 from bending resiliently in the direction that allows the male terminal fittings 20 to be removed. By this means, the male terminal fittings 20 are maintained in a doubly retained state within the cavities 12, being retained by the plastic lances 13 and doubly retained by the retainer 40.

After the connector has been assembled in the manner described above, the corresponding connector F may be fitted into the hood 11. The corresponding connector F and the moving plate 30 are moved as a single unit while the corresponding connector F is being fitted, and the tabs 21 that are maintained in position by the position fixing holes 33 of the moving plate 30 are reliably fitted together with and make contact with the female terminal fittings of the corresponding connector F.

Figure 4:
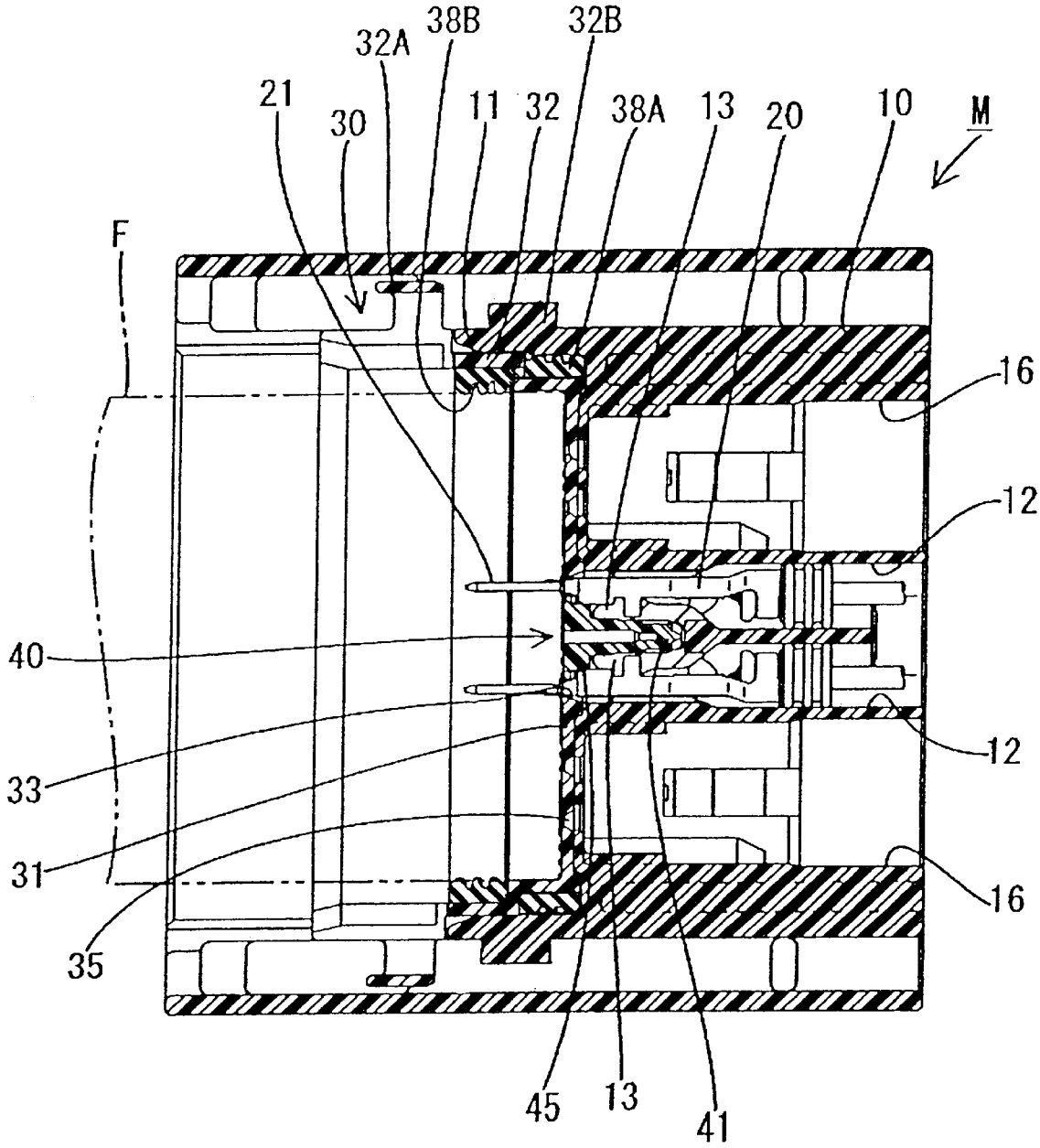
FIG. 4 is a horizontal cross-sectional view showing a connector fitted with a corresponding connector.
Figure 5:
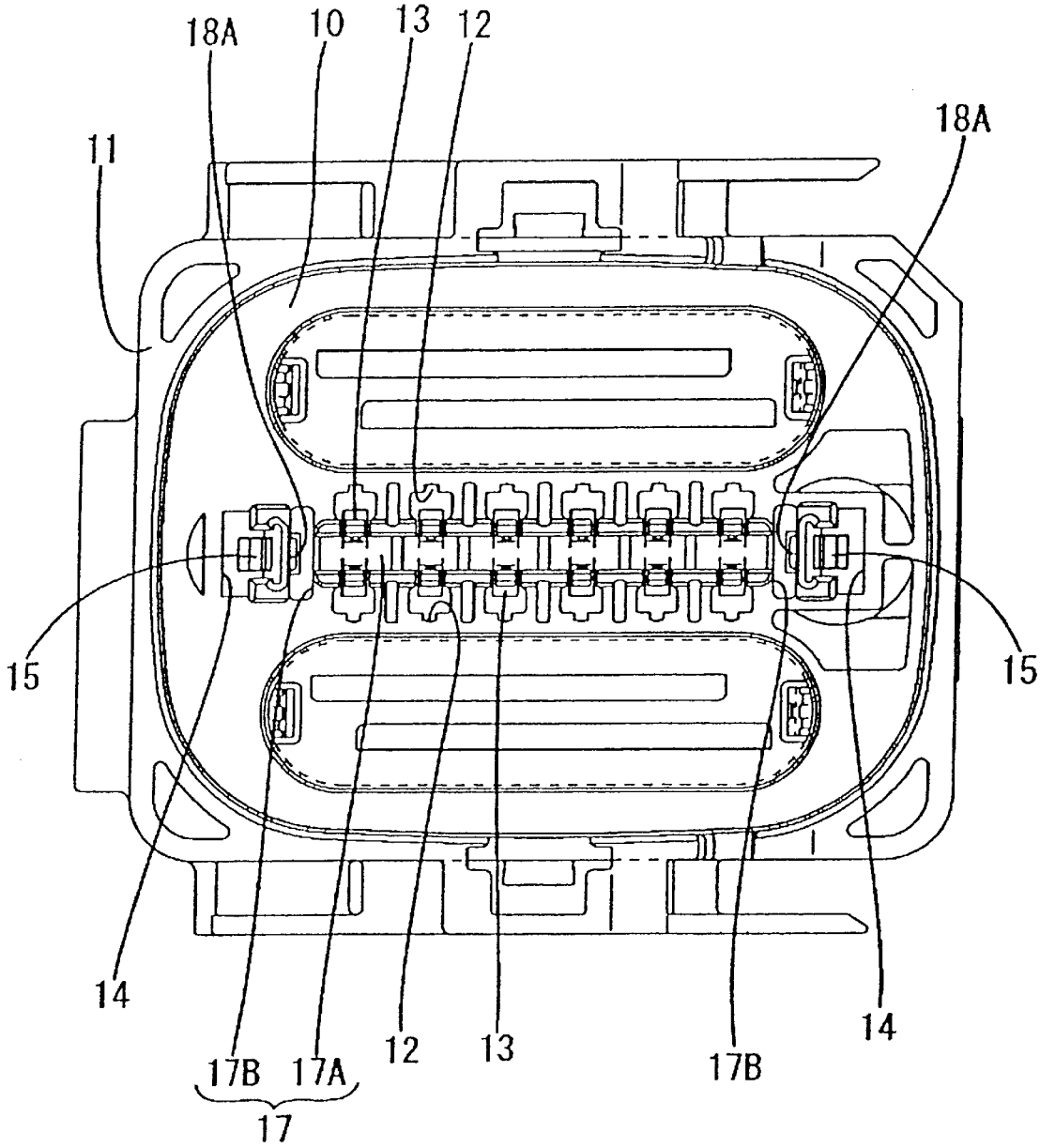
FIG. 5 is a front view of a connector housing.
Figure 6:
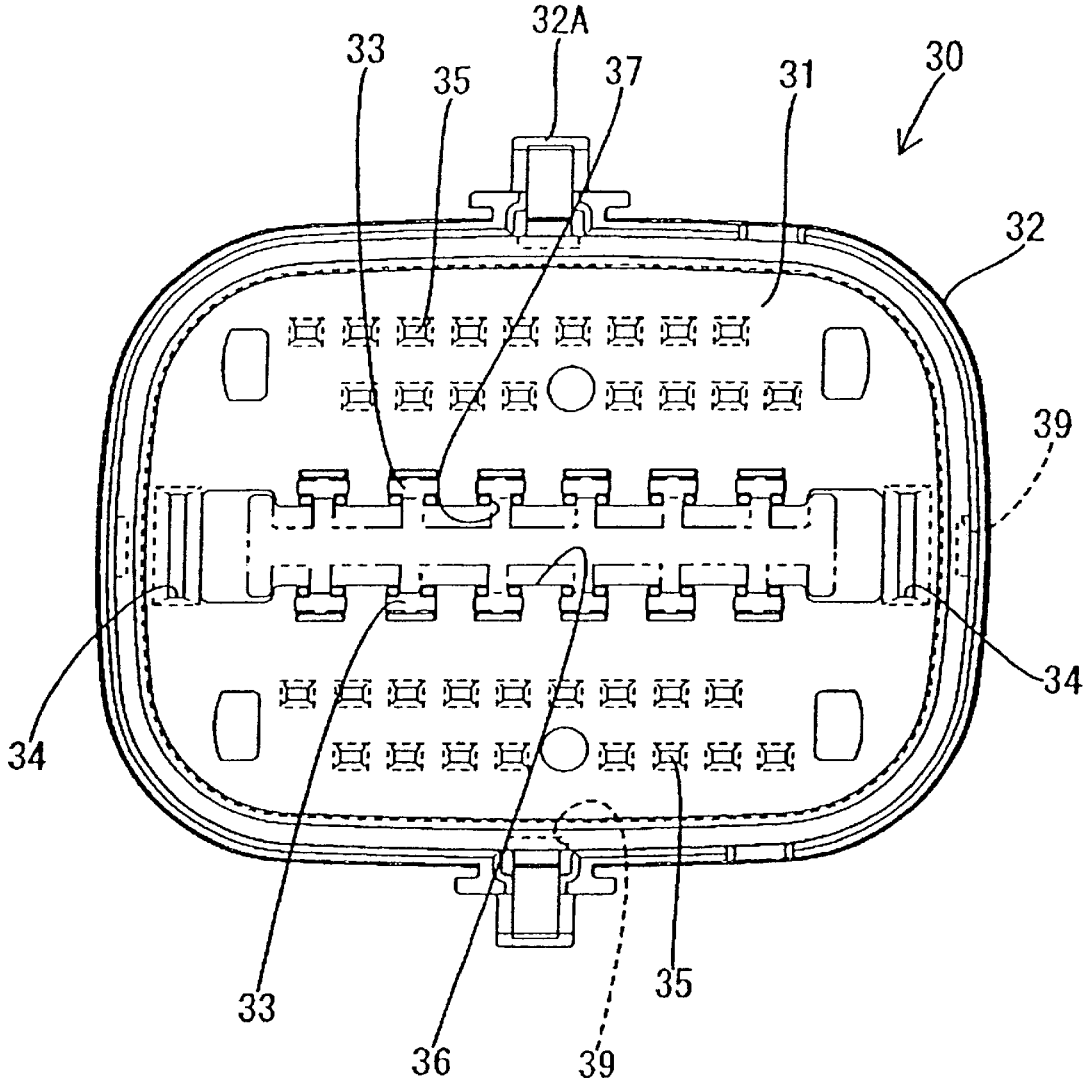
FIG. 6 is a front view showing the retainer fitted through a window hole of a moving plate.
Figure 7:
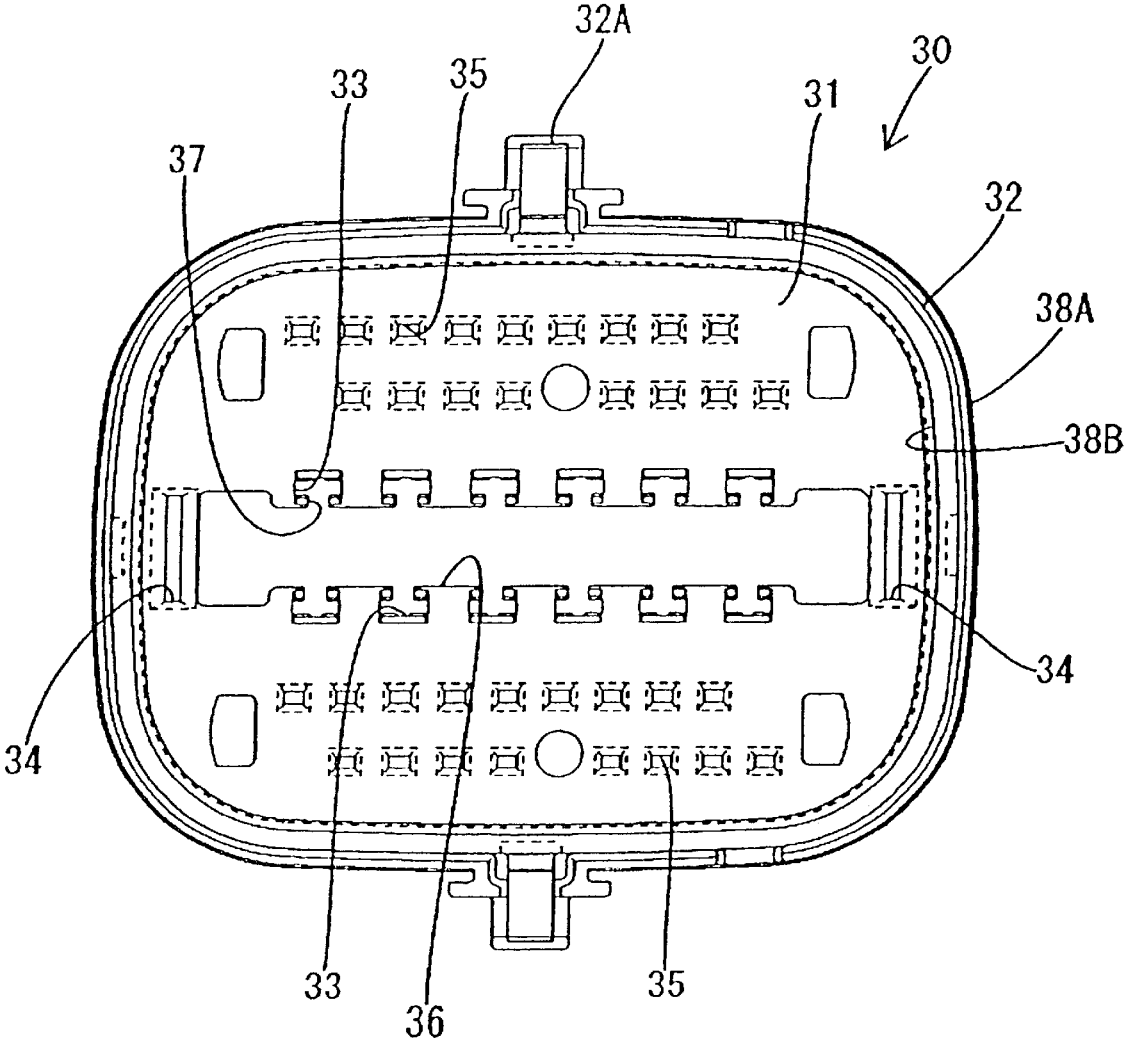
FIG. 7 is a front view of the moving plate.
Figure 8:
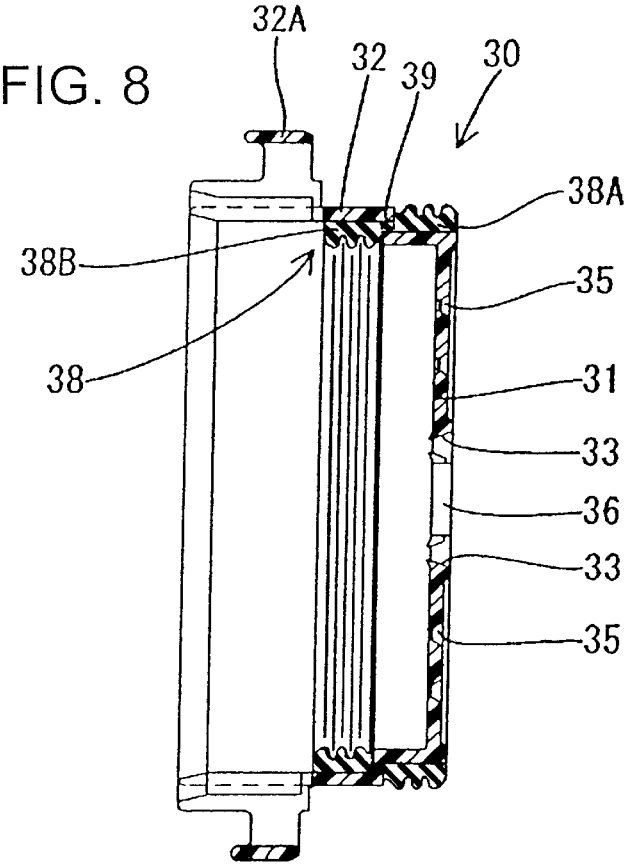
FIG. 8 is a vertical cross-sectional view of the moving plate.
Figure 9:
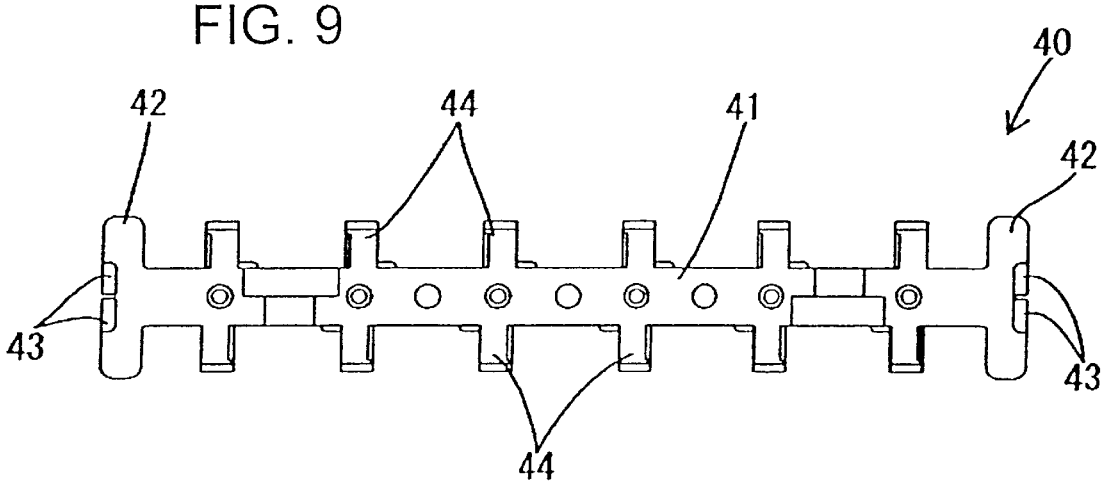
FIG. 9 is a front view of the retainer.
Figure 10:
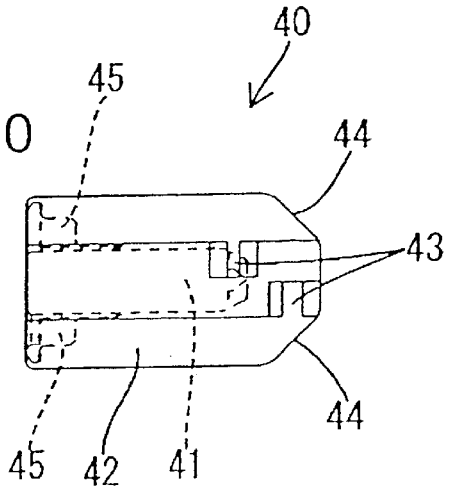
FIG. 10 is a side face view of the retainer.
Figure 11:
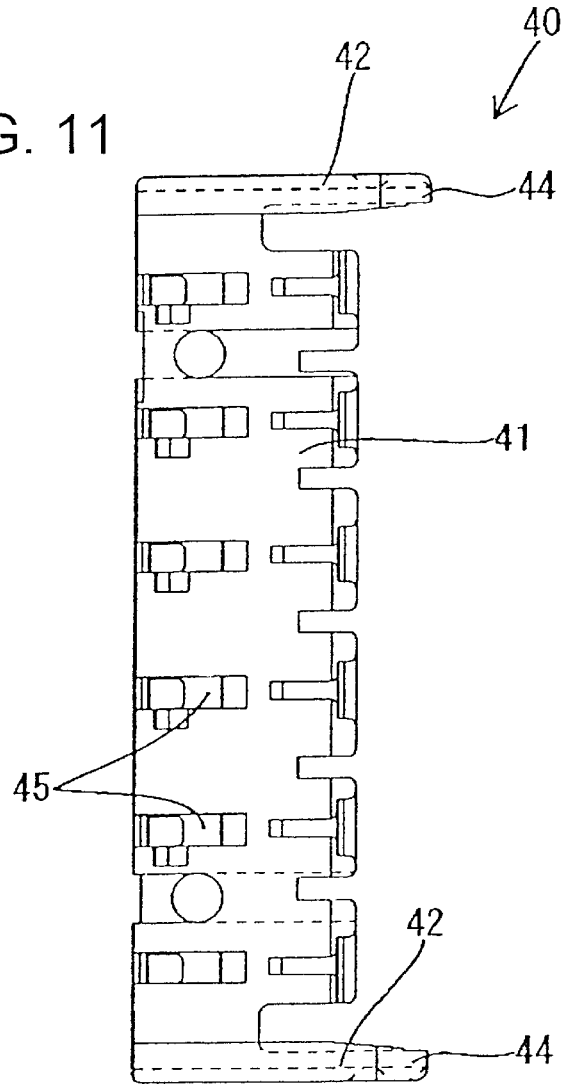
FIG. 11 is a plan view of the retainer.
Figure 12:
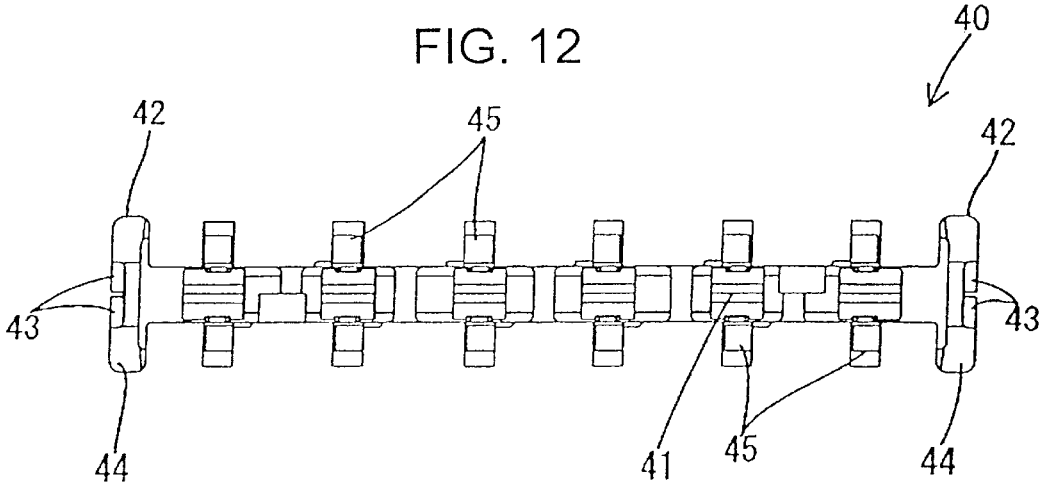
FIG. 12 is a rear face view of the retainer.
Figure 13:
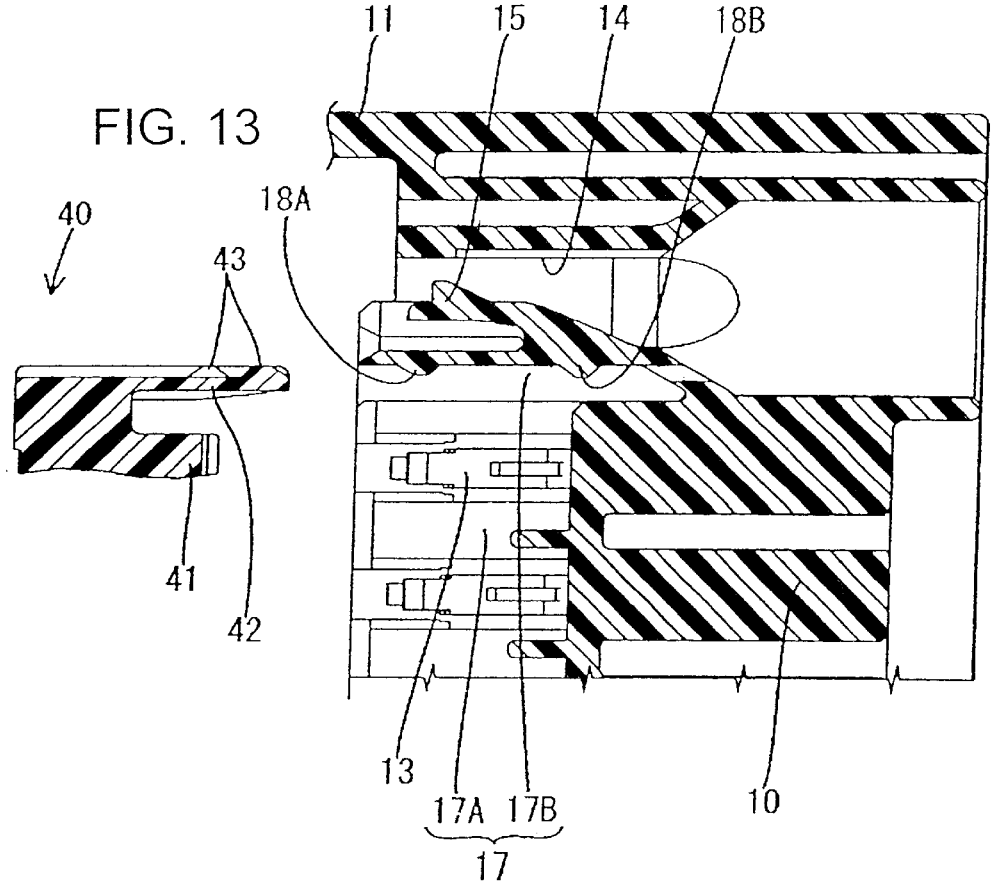
FIG. 13 a partially enlarged horizontal cross-sectional view showing the retainer in a removed state.
Figure 14:
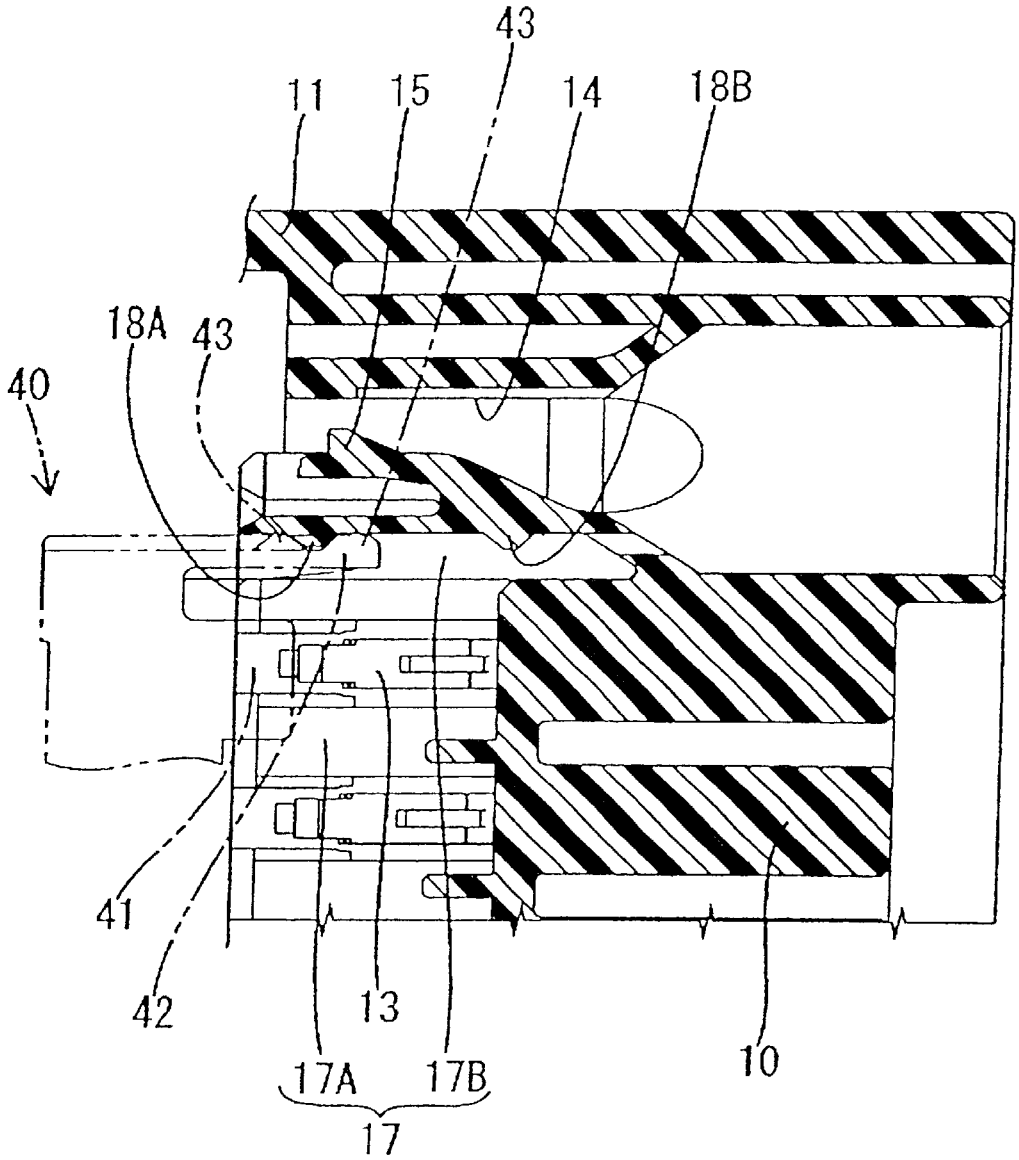
FIG. 14 is a partially enlarged horizontal cross-sectional view showing the retainer in the temporary retaining state.
Figure 15:
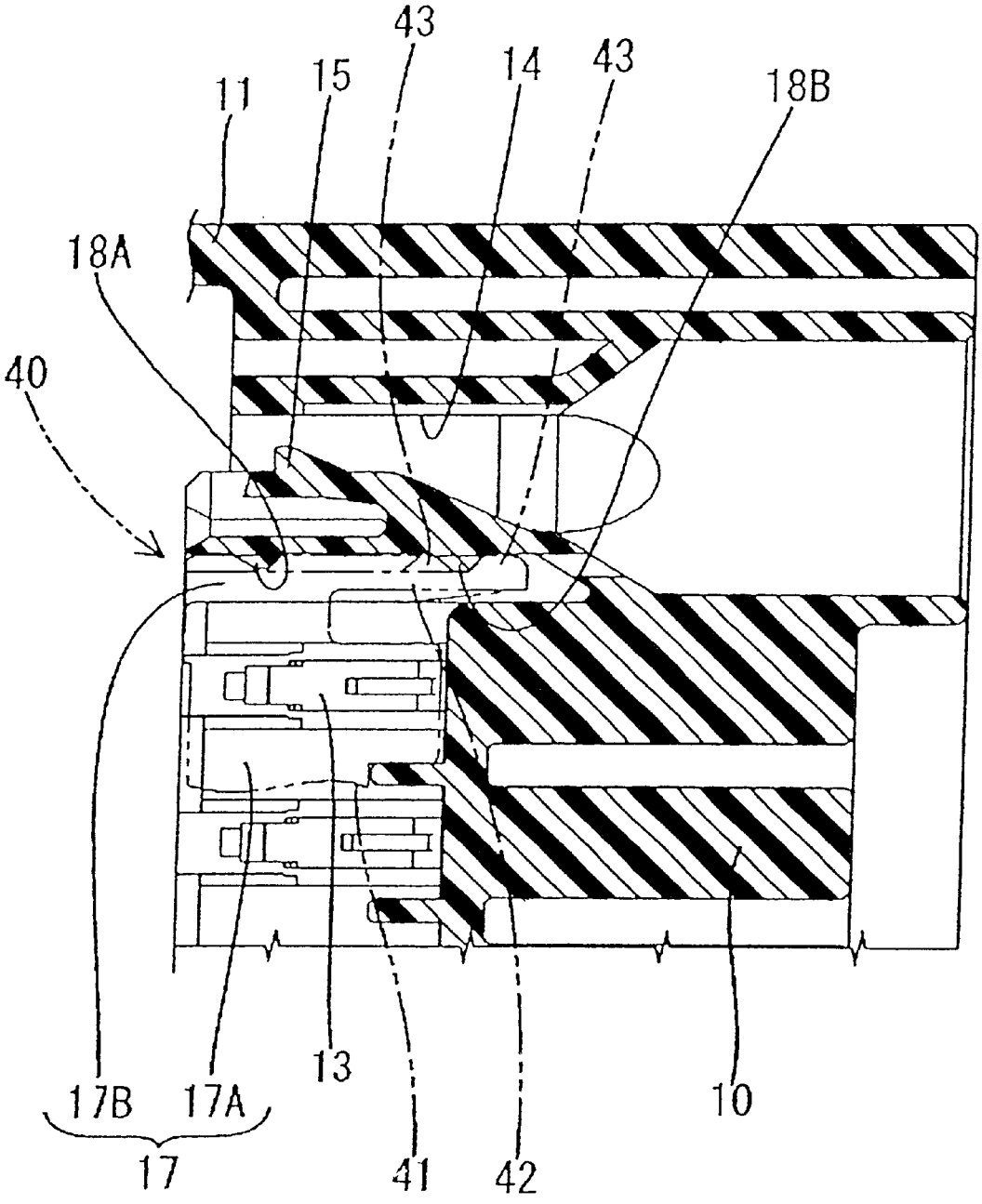
FIG. 15 is a partially enlarged horizontal cross-sectional view showing the retainer in the main retaining state.

As shown in FIG. 4, when the corresponding connector F is in a fitted state, the outer circumference sealing member 38A of the moving plate 30 fits tightly with the inner circumference of the hood 11, thereby waterproofing the space between the moving plate 30 and the hood 11. Furthermore, the inner circumference sealing member 38B of the moving plate 30 fits tightly with an outer circumference of the corresponding connector F, thereby waterproofing the space between the moving plate 30 and the corresponding connector F. The sealing member 38 thus seals the space between the hood 11 and the corresponding connector F. Moreover, the retainer attachment hole 17 is located inwards relative to the anterior end face of the connector housing 10 on which the sealing member 38 is located. Consequently, the retainer attachment hole 17 is also waterproofed by the sealing member 38.

In the embodiment described above, the moving plate 30 has the window hole 36 formed therein on the face opposite the retainer 40. The retainer 40 protrudes towards the anterior via this window hole 36, this allowing the retainer 40 to be pushed (from the temporary retaining position to the main retaining position) from the anterior of the moving plate 30. That is, the retainer 40 can be attached from the anterior relative to the connector housing 10.

Furthermore, the retainer 40 can pass in an anterior-posterior direction through the window hole 36 of the moving plate 30. Consequently, the retainer 40 can be attached after the moving plate 30 has been attached within the hood 11. In the present embodiment, the moving plate 30 is attached first, then the retainer 40 is attached thereafter. However, the retainer 40 may equally well be attached first, and the moving plate 30 attached thereafter.

Since the moving plate 30 has the window hole 36 formed therein, the retainer 40 can be attached from the anterior. This means that the connector housing 10 requires no opening on its outer side face for attaching the retainer 40. Further, the retainer attachment hole 17 is located at the innermost face of the hood 11, thus being surrounded by the inner circumference of the hood 11. Consequently, the fitting portion of the corresponding connector F and the retainer attachment hole 17 can simultaneously be waterproofed merely by providing the sealing member 38 between the inner circumference of the hood 11 and the outer circumference of the corresponding connector F.

The retainer 40 is provided with the guiding members 42 which are inserted prior to the removal preventing member 41 when the retainer 40 is inserted into the retainer attachment hole 17. Consequently, these guiding members 42 are inserted first into the retainer attachment hole 17 when the retainer 40 is being attached, this stabilizing and maintaining the position of the retainer 40 relative to the connector housing 10. By this means, the retainer 40 can be attached smoothly and reliably.

The guiding members 42 are provided as a pair, one at either end of the removal preventing member 41. Consequently, the retainer 40 is less likely to become inclined than in the case where a guiding member is provided on only one end.

Further, the tapered guiding tips 44 are formed at the tip ends of the guiding members 42. These simplify the insertion of the guiding members 42 into the retainer attachment hole 17.

The stopping members 43 are formed in the guiding members 42, these maintaining the retainer 40 in the temporary retaining position or the main retaining position. Consequently, the retainer 40, as a whole, is simpler and smaller than in the case where stopping members are provided in locations separate from the guiding members 42.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, the entirety of the retainer protrudes towards the anterior from the window hole of the moving plate. However, according to the present invention, only a portion of the retainer may equally well protrude towards the anterior from the window hole.

(2) In the embodiment described above, an example was described which was suitable for a waterproof connector. However, the present invention can be made equally suitable for a connector which is not a waterproof connector.

(3) In the embodiment described above, the means to waterproof the space between the hood and the corresponding connector comprises sealing rings that extend along the inner circumference and the outer circumference of the moving plate. However, according to the present invention, a sealing member attached to the inner circumference of the hood may equally be arranged to fit tightly and directly with the outer circumference of the corresponding connector.

(4) In the embodiment described above, when the retainer is in the temporary retaining position, the anterior end face thereof forms an approximately unified face with the anterior end face of the plate main body of the moving plate. However, according to the present invention, the anterior end face of the retainer may equally well be located to the anterior relative to the anterior end face of the plate main body (in a state whereby the retainer protrudes to the anterior of the window hole) or located to the posterior thereof (in a state whereby the retainer is located inwards relative to the window hole).

What is claimed is:

1. An electrical connector comprising a housing having a hood protruding at the anterior side in the connection direction thereof, terminal fittings insertable into said housing from the posterior side to protrude into said hood, a movable plate within said hood and adapted for movement in an anterior/posterior direction, said plate having holes through which said fittings protrude in use, and a retainer movable in said housing to retain terminal fittings therein, characterized in that said housing includes a retainer attachment opening in the anterior side thereof at the innermost face of said hood, and a window is provided in said movable plate to permit insertion of said retainer therethrough.

2. A connector according to claim 1 wherein said window permits said retainer to pass through from the anterior side to the posterior side.

3. A connector according to claim 1 wherein said hood is circumferentially continuous.

4. A connector according to claim 2 wherein said hood is circumferentially continuous.

5. A connector according to claim 3 and further including an internal sealing member adapted to seal the inner circumference of said hood to an outer circumference of a corresponding connector.

6. A connector according to claim 5 wherein said sealing member includes an outer seal provided on a periphery of said movable plate.

7. A connector according to claim 6 wherein said movable plate comprises a plate-like base and a continuous wall upstanding therefrom, said outer seal being provided on the outer circumference of said wall.

8. A connector according to claim 7 wherein said sealing member further comprises an inner seal provided on the inner circumference of said wall and for engagement with the outer circumference of a corresponding connector.

9. A connector according to claim 8 wherein said inner seal and said outer seal have continues circumferentially extending lips.

10. A connector according to claim 8 wherein said inner seal and said outer seal are spaced in the anterior/posterior direction.

11. A connector according to claim 9 wherein said inner seal and said outer seal are spaced in the anterior/posterior direction.

12. A connector according to claim 8 wherein said inner seal and outer seal are connected via apertures of said wall.

13. A connector according to claim 9 wherein said inner seal and outer seal are connected via apertures of said wall.

14. A connector according to claim 10 wherein said inner seal and outer seal are connected via apertures of said wall.

* * * * *

UNITED STATES PATENT AND TRADEMARK OFFICE

CERTIFICATE OF CORRECTION

PATENT NO. : 6,634,907 B2
DATED : October 21, 2003
INVENTOR(S) : Kozue Takatsuki et al.

It is certified that error appears in the above-identified patent and that said Letters Patent is hereby corrected as shown below:

Column 8,
Line 52, "continues" has been replaced with -- continuous --.

Signed and Sealed this

Twenty-fourth Day of February, 2004

JON W. DUDAS
*Acting Director of the United States Patent and Trademark Office*